US007913978B1

(12) United States Patent
Trihey et al.

(10) Patent No.: US 7,913,978 B1
(45) Date of Patent: Mar. 29, 2011

(54) PORTABLE POWERED WINCH

(75) Inventors: Michael R Trihey, Roseau, MN (US); David A Foss, Greenbush, MN (US)

(73) Assignee: Polaris Industries Inc., Medina, MN (US)

( * ) Notice: Subject to any disclaimer, the term of this patent is extended or adjusted under 35 U.S.C. 154(b) by 854 days.

(21) Appl. No.: 11/544,827

(22) Filed: Oct. 6, 2006

(51) Int. Cl.
*B66D 1/00* (2006.01)

(52) U.S. Cl. ..... 254/323; 254/328

(58) Field of Classification Search ..... 254/323, 254/328

See application file for complete search history.

(56) References Cited

U.S. PATENT DOCUMENTS

| | | | | |
|---|---|---|---|---|
| 2,894,605 | A * | 7/1959 | Leavitt | 187/224 |
| 3,385,401 | A * | 5/1968 | Campbell et al. | 187/222 |
| 3,829,064 | A * | 8/1974 | Jackson | 254/323 |
| 4,183,423 | A * | 1/1980 | Lewis | 182/103 |
| 4,331,323 | A * | 5/1982 | Sekimori et al. | 254/323 |
| 4,552,340 | A * | 11/1985 | Sheppard | 254/358 |
| 4,588,167 | A * | 5/1986 | Finzel | 254/346 |
| 4,650,163 | A * | 3/1987 | Peterson | 254/327 |
| 4,736,929 | A * | 4/1988 | McMorris | 254/344 |
| 4,773,628 | A * | 9/1988 | Aleshire | 254/134.4 |
| 4,884,784 | A | 12/1989 | Nix et al. | |
| 5,002,259 | A * | 3/1991 | Manning et al. | 254/350 |
| 5,072,962 | A * | 12/1991 | Webb | 280/414.1 |
| 5,474,278 | A * | 12/1995 | Cleveland | 254/334 |
| 5,511,929 | A | 4/1996 | Loftus | |
| 5,522,582 | A * | 6/1996 | Dilks | 254/323 |
| 5,573,091 | A * | 11/1996 | Hung | 192/12 R |
| 5,791,633 | A * | 8/1998 | Walker | 254/323 |
| 5,871,069 | A * | 2/1999 | Carmitchel | 187/231 |
| 6,241,215 | B1 * | 6/2001 | Gersemsky et al. | 254/342 |
| 6,309,168 | B1 * | 10/2001 | Holmes | 414/490 |
| 6,371,449 | B1 * | 4/2002 | Chamberlain | 254/387 |
| 6,386,514 | B1 | 5/2002 | Ray | |
| 6,494,437 | B1 * | 12/2002 | Boyer | 254/323 |
| 6,575,184 | B2 | 6/2003 | Kozak | |
| 6,595,495 | B1 * | 7/2003 | Hung | 254/326 |
| 6,672,568 | B1 * | 1/2004 | Rawlinson | 254/323 |
| 6,756,764 | B2 | 6/2004 | Smith et al. | |
| 6,981,695 | B1 | 1/2006 | Hedlund et al. | |
| 7,000,904 | B2 * | 2/2006 | Huang | 254/323 |
| 7,261,277 | B2 * | 8/2007 | Copeman | 254/323 |
| 7,431,268 | B2 * | 10/2008 | Steiner et al. | 254/323 |
| 7,543,798 | B2 | 6/2009 | Cunningham | |
| 2004/0239290 | A1 | 12/2004 | Kreiger | |
| 2005/0217025 | A1 * | 10/2005 | Barattia | 5/86.1 |
| 2005/0230340 | A1 * | 10/2005 | Barger et al. | 212/280 |
| 2007/0216115 | A1 * | 9/2007 | Warner | 280/47.27 |

FOREIGN PATENT DOCUMENTS

| | | |
|---|---|---|
| CH | 562 159 | 5/1975 |

OTHER PUBLICATIONS

Color Photograph of Conventional Battery Packs.

* cited by examiner

*Primary Examiner* — Emmanuel M Marcelo
(74) *Attorney, Agent, or Firm* — Baker & Daniels LLP

(57) ABSTRACT

A portable powered winch is provided suitable for coupling to a vehicle. The winch is comprised of a frame which mounts the winch and a housing. The housing houses a battery and mounts a control panel thereto. The frame has a mount for receiving a mounting tube of a vehicle, and is disconnectable when not desired for mounting and for use portably. A dolly may be included for transporting the winch.

22 Claims, 10 Drawing Sheets

PORTABLE POWERED WINCH

FIELD OF THE INVENTION

The present invention relates to winches, and more particularly to a portable winch, that is alternatively used alone, or is mountable on a vehicle.

BACKGROUND OF THE INVENTION

Winches are common outdoor tools and are used for many applications. A winch is typically comprised of a bi-directional motor, which drives a cable drum around which a cable is wrapped. One end of the cable is secured to the drum while the free end of the cable includes a hook or other clevis. A typical winch has a cable made of wound metal strands, rope, chain, or other similar material having high tensile strength wound around the drum. Thus when the motor turns in one direction, the cable can be fed outwardly, while the motor turns in the opposite direction, the cable is pulled inwardly, creating a pulling force on the cable and the hook. Thus the winch is used in a situation where a pulling force on an item is required and the winch is relatively fixed relative to another object. In some cases the winch can be used in a portable sense, where the winch is attached to a fixed item such as a tree or other item, or the winch can be attached to a vehicle such as all terrain vehicle (ATV), snowmobile, four-wheel drive vehicle and the like. U.S. Pat. No. 6,981,695 shows multiple winches mounted to the vehicle, and is incorporated herein.

By way of example, the addition of a winch to an ATV provides further utility to the vehicle. ATVs are multipurpose vehicles that are popular for recreational use, such as camping, fishing, and hunting. The adaptability and versatility of an ATV can support many off-road tasks within agriculture, forestry, horticulture and utility applications. In addition, this adaptability and versatility also make ATVs ideal for military use. ATVs easily traverse various off-highway trails, reach rugged locations that other vehicles cannot, and offer business operators the opportunity to accomplish work in the field at significant financial savings when compared to using a truck, tractor or other 4-wheel drive vehicle. Utility ATVs, especially suited for hauling and towing as well as trail riding, are as popular as ATVs for weekend recreational riding. ATVs operate in all climates and are among the most versatile vehicles in operation today. One such example of an ATV is shown in our U.S. Pat. No. 6,981,695, incorporated herein by reference.

The winch can be used in a variety of ways, which provide great assistance to the vehicle driver. For example, one end of the cable may be attached to a stationary object and the winch used to help move or extricate the vehicle from a stuck position. Additionally, one end of the cable may be attached to an object in order to hoist or haul it, or to remove an obstacle from the road in order for the vehicle to pass.

While the vehicle mounted winch has multiple attributes, the shortcoming is that the winch is permanently coupled to the vehicle, and the winch can only be used in conjunction with the vehicle, or where the vehicle may maneuver. Moreover, as the winches are hardwired and powered by the vehicle's battery, extended use of the winch can reduce vehicle battery voltage to below starting requirements and may strand the operator without sufficient battery power.

SUMMARY OF THE INVENTION

A combination portable winch, comprises a frame; a power source selectively mounted on the frame; and an electric winch mounted to the frame, the electric winch comprising an electric motor coupled to the power source.

The device may further comprise a jumper for electrically coupling the power source to a power-consuming device separate from the frame to provide power thereto. The power source may provide power to a power-consuming device regardless of whether the power source is mounted on the frame. The frame may provide a carrying handle for the device.

The frame may comprise a mounting mechanism for mounting the frame to a vehicle. The mounting mechanism may be profiled for mounting the frame to a stay. The frame may comprise a first mounting mechanism for mounting the frame to a vehicle, and a second mounting mechanism for mounting the frame to a stay. The device may further comprise a remote control to operate the device. The remote control may be a tethered remote control.

In another embodiment, a portable winch apparatus, comprises a frame; a mount associated with the frame for alternatively mounting the frame to a vehicle or to a stay; and an electric winch mounted to the frame.

The apparatus may further comprises a power source mounted on the frame. The apparatus may also further comprise a jumper for electrically coupling the power source to a power-consuming device separate from the frame to provide power thereto. The electric winch comprises an electric motor coupled to the power source. The mount is sized and shaped to be mounted at a plurality of locations on a vehicle. The power source may be electrically coupled to a power source of the vehicle. The power source may be a battery. The apparatus may further comprise a housing substantially enclosing the power source. The apparatus may also further comprise controls for directing the operation of the winch, the controls being located externally of the housing. The apparatus may also further comprise quick disconnect connections between the power source and the electric motor of the winch.

A portable winch apparatus, comprises a frame; a power source selectively mounted on the frame; a winch mounted to the frame, the winch comprising an electric motor coupled to the power source, and a handle for carry the apparatus.

The frame may be selectively and alternatively coupled to a vehicle, or to a stay. The apparatus may further comprise a mount associated with the frame wherein the mount is profiled for connection to a hitch located at the periphery of the vehicle. The frame may comprise a first mounting mechanism for mounting the frame to a vehicle, and a second mounting mechanism for mounting the frame to a stay. The handle may provide a fulcrum for carrying, the winch and the power source being attached to the frame on opposite sides of the fulcrum for weight distribution.

The power source may be removable from the frame. The handle may be integrated with the frame. The power source may be a battery pack, the battery pack comprising a housing having a handle, the battery pack handle being positioned proximate the frame handle, whereby a user may grasp both the frame handle and battery pack handle for carrying.

In another embodiment, a portable winch apparatus comprises a frame. A mounting mechanism is associated with the frame for mounting the frame to a stay. An electric winch is mounted to the frame, the winch having a cable feed opening. The mounting mechanism and the feed opening being profiled to apply insubstantial torque to the winch when in operation.

The frame may be profiled for alternatively mounting the frame to a vehicle or to a stay. The mounting mechanism may be comprised of two openings positioned at the opposite side of the frame as said cable feed opening. The vertical height of the cable feed opening, and the mounting mechanism is substantially equal. The lateral position of the cable feed opening may be substantially centered with the lateral position of the mount.

The portable winch may further comprise a mounting aperture adjacent to, and substantially laterally aligned with, the feed opening. The portable winch, further comprising a pulley for placement around a cable of said winch, whereby a hook at a free end of said cable may attached to the mounting aperture placing the combination of the winch and pulley in a block and tackle configuration. The pulley may include two plates with a pulley wheel rotatably attached therebetween, at least one of said walls being rotatable to access said pulley wheel.

In yet another embodiment, a portable winch, comprises a power source; an electric winch comprising an electric motor coupled to the power source; and a remote control electrically connected to the electric motor to operate the device.

The winch may further comprise a frame, to which the electric winch and power source are mounted. The frame comprises a mounting mechanism for mounting the frame to a vehicle. The device comprises a mounting mechanism for mounting the frame to a stay. The remote control may be comprised of a tethered switch, or a wireless control switch.

In a further embodiment, a portable winch comprises a power source; an electric winch comprising an electric motor coupled to the power source; and a dolly for carrying the power source and electric winch.

The device may further comprise a frame, to which the electric winch and power source are mounted. The frame may comprise a mounting mechanism for mounting the dolly to the frame.

The above mentioned and other features of this invention, and the manner of attaining them, will become more apparent and the invention itself will be better understood by reference to the following description of embodiments of the invention taken in conjunction with the accompanying drawings.

DETAILED DESCRIPTION OF EMBODIMENTS OF THE INVENTION

Figure 1:
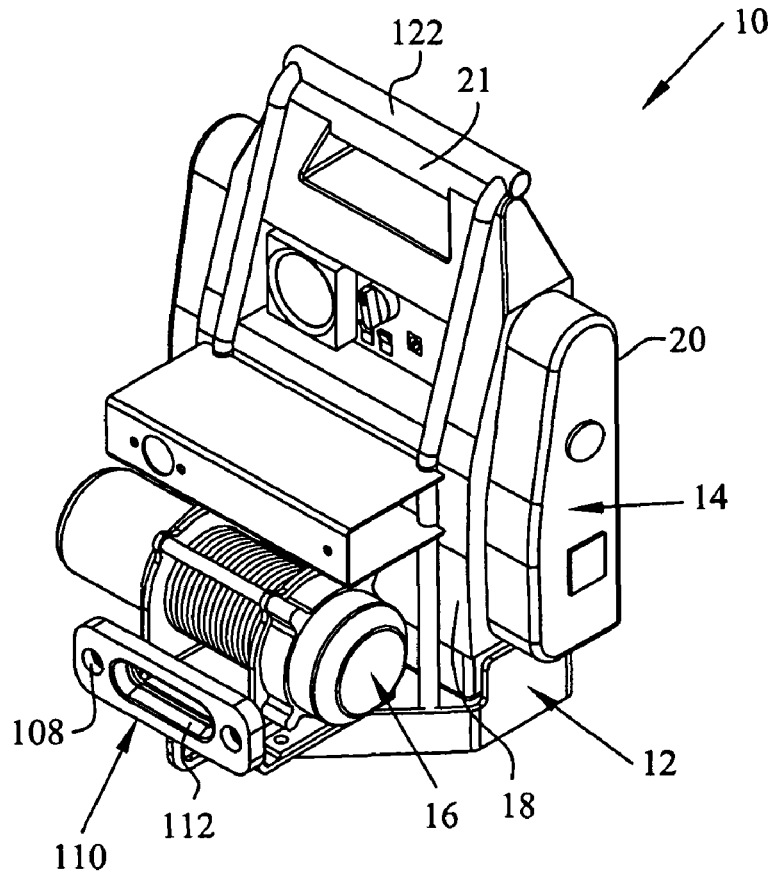
FIG. 1 is a front upper perspective view of a winch assembly according to an illustrative embodiment.

Corresponding reference characters indicate corresponding parts throughout the several views. Although the drawings represent embodiments of the present invention, the drawings are not necessarily to scale and certain features may be exaggerated in order to better illustrate and explain the present invention.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

Figure 2:
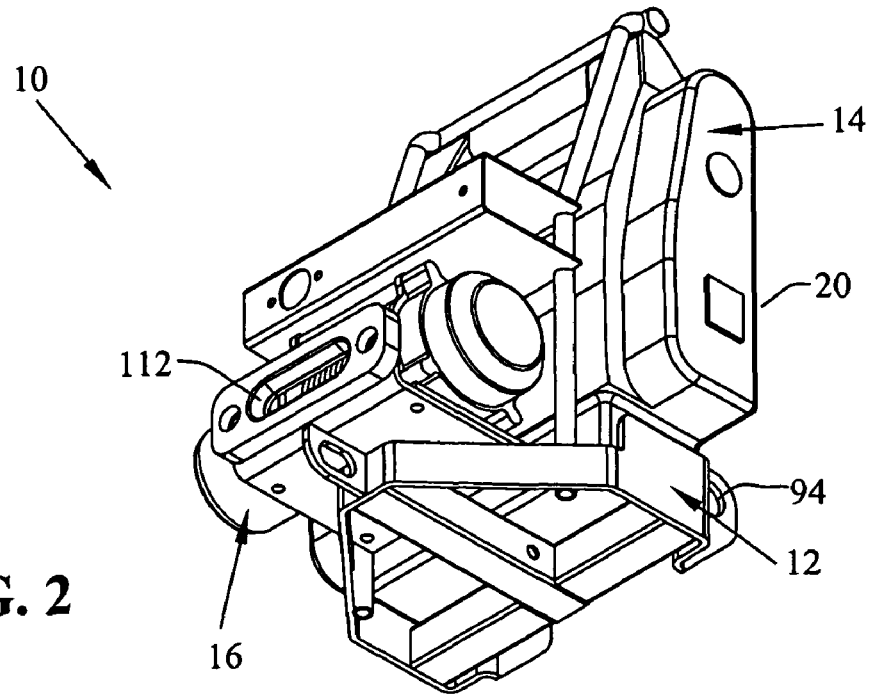
FIG. 2 is a front underside perspective view of the winch assembly of FIG. 1.
Figure 3:
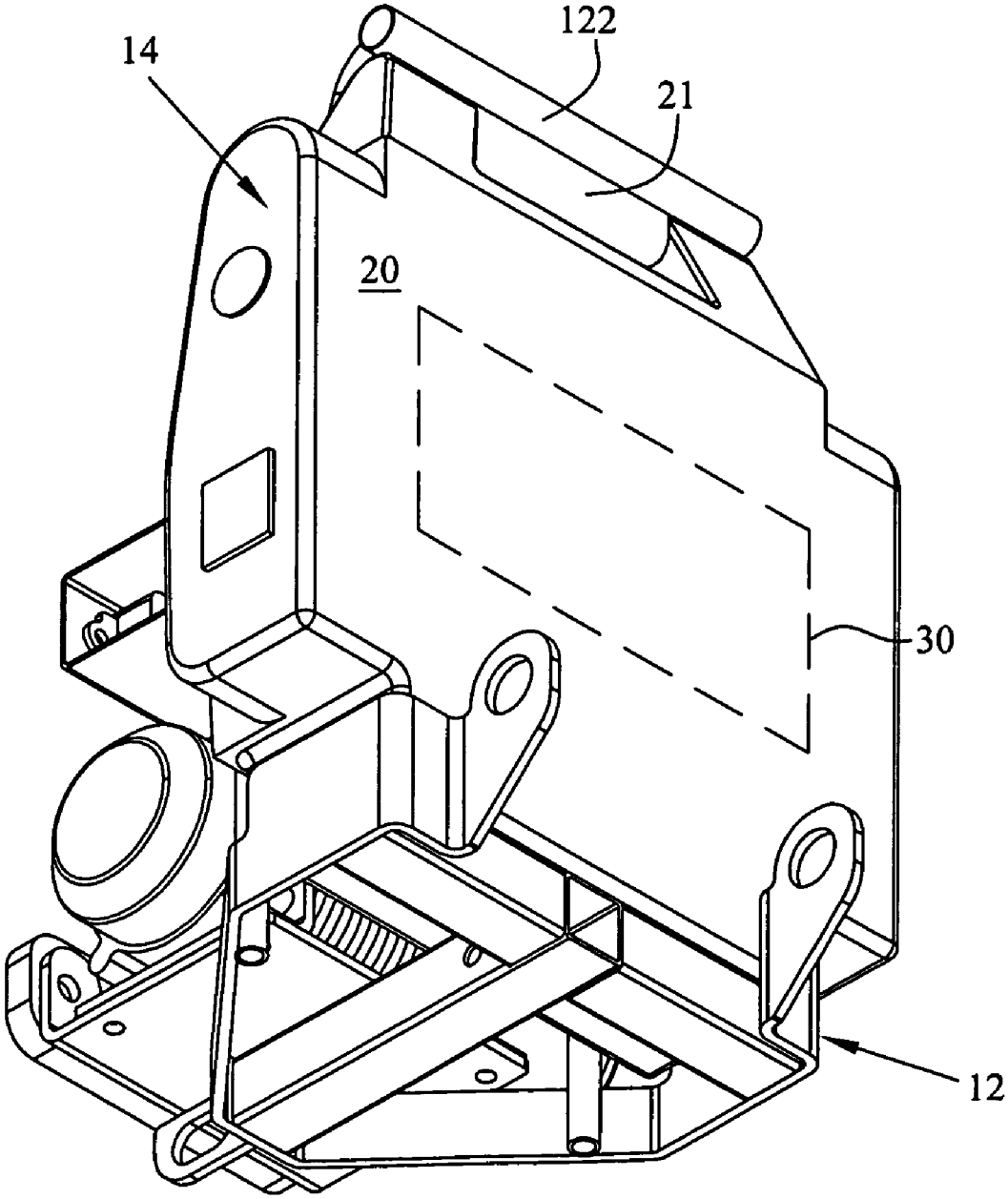
FIG. 3 is a rear underside perspective view of the winch assembly of FIG. 1.

With reference first to FIGS. 1-3, a portable powered winch 10 is illustrated, which generally comprises a frame 12, to which is mounted, a high power battery booster pack 14 and a winch 16. Battery booster pack 14 includes a front housing 18 and back housing 20 that combine to house a battery (not shown) or other power source therein. Battery booster pack further includes an integrally molded handle 21 for carrying.

Figure 4:
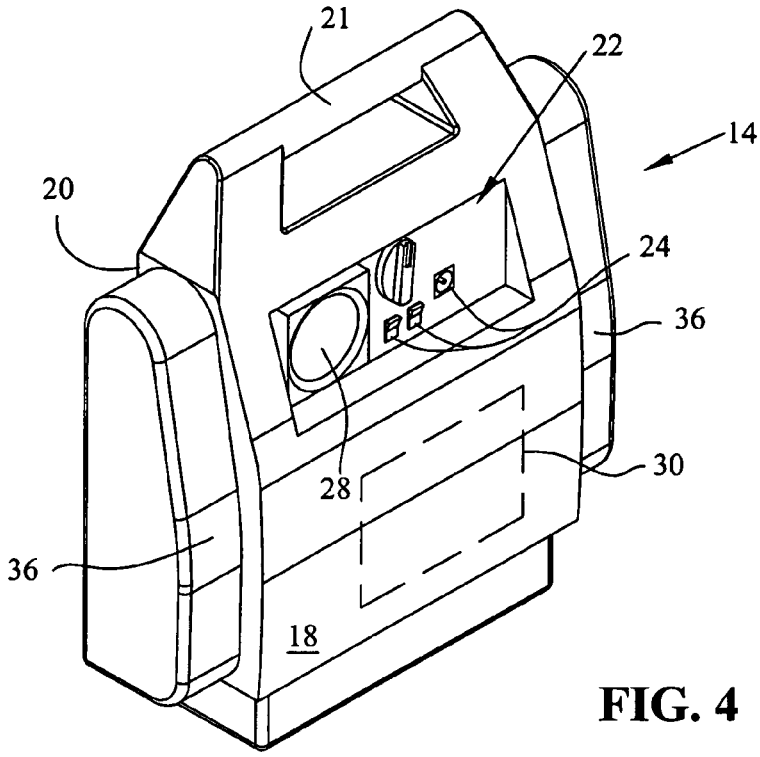
FIG. 4 is a top perspective of the battery booster pack shown in the assembled view of FIGS. 1-3.
Figure 5:
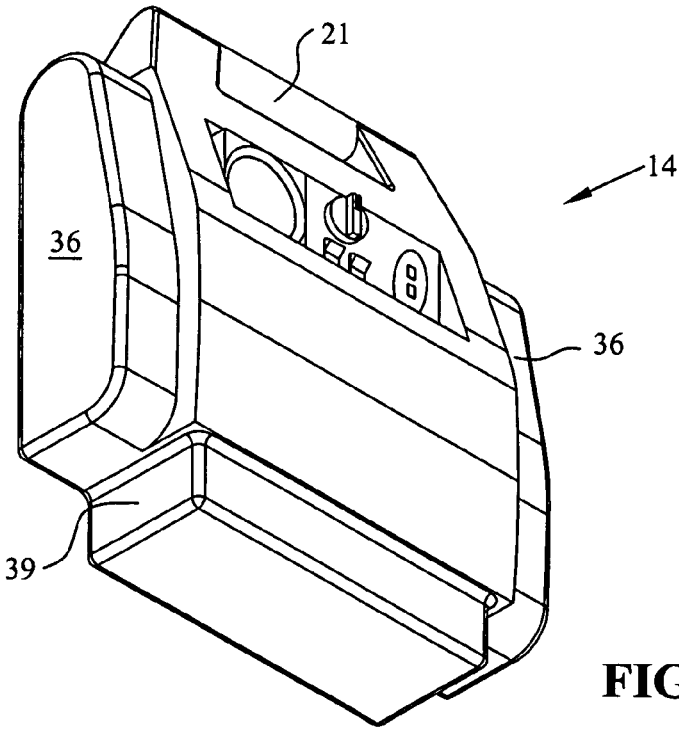
FIG. 5 is a lower perspective of the battery booster pack shown in the assembled view of FIGS. 1-3.

With reference now to FIGS. 4 and 5, battery booster pack 14 includes a control panel 22, having a plurality of controls 24, and a light 28, which upon activation from one of the controls 24, draws power from the battery to provide illumination for a user. Controls 24 further include information regarding the state of the battery charge. Information sheet 30 may be provided as a placard on the front (FIG. 4) or rear (FIG. 3) to provide instructions to the user on how to operate powered winch 10, safety information, specifications, or other information to be conveyed to a user.

Figure 7:
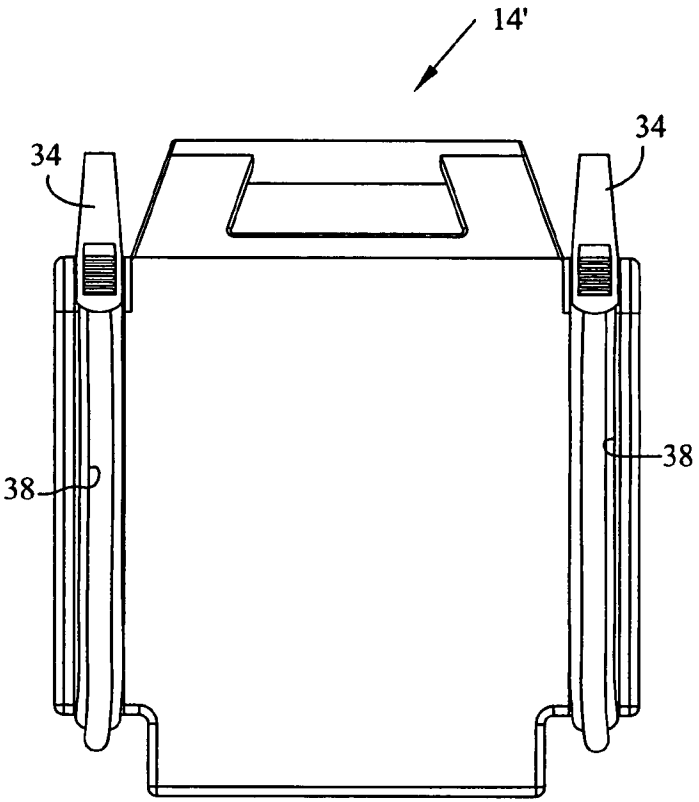
FIGS. 6 and 7 show alternate battery booster packs.
Figure 6:
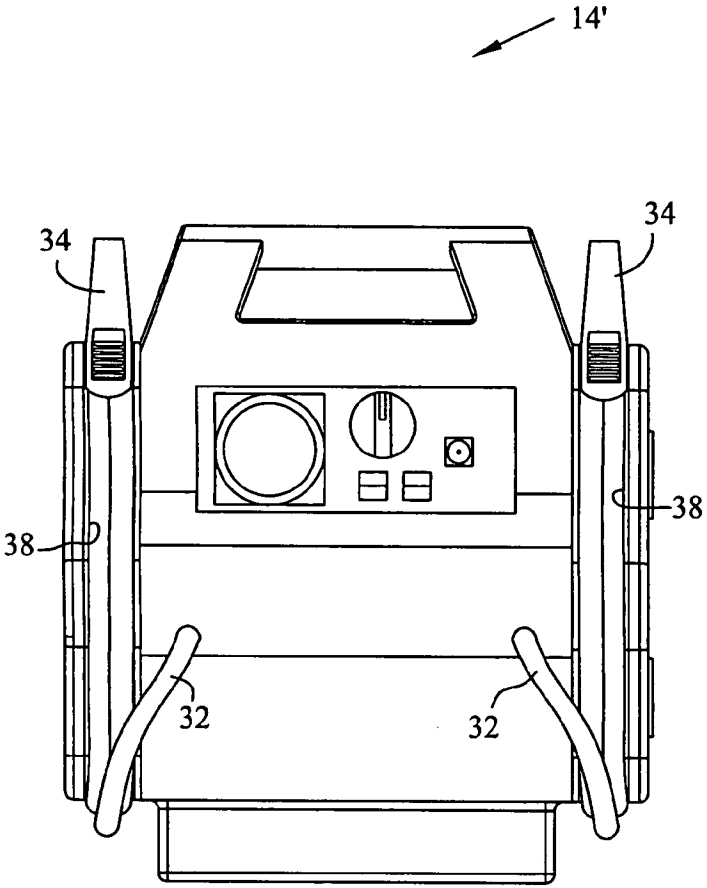

Battery booster pack 14 further comprises jumper cables 32 extending outwardly from housing 18 which are electrically coupled to the battery. Jumper clamps 34 are provided which are suitable for connection to a separate battery. Battery booster pack 14 may include housing side portions 36, around which, cables 32 may be wrapped, as shown in FIGS. 6 and 7. As shown in FIG. 6, housing side portions 36 may include recessed portions 38, including a recessed back portion, as shown in FIG. 7, that are profiled and shaped to receive jumper cables therein in a storage position. Housing 18 further includes a reduced profile portion 39, as best shown in FIG. 5, and as described herein.

Figure 8:
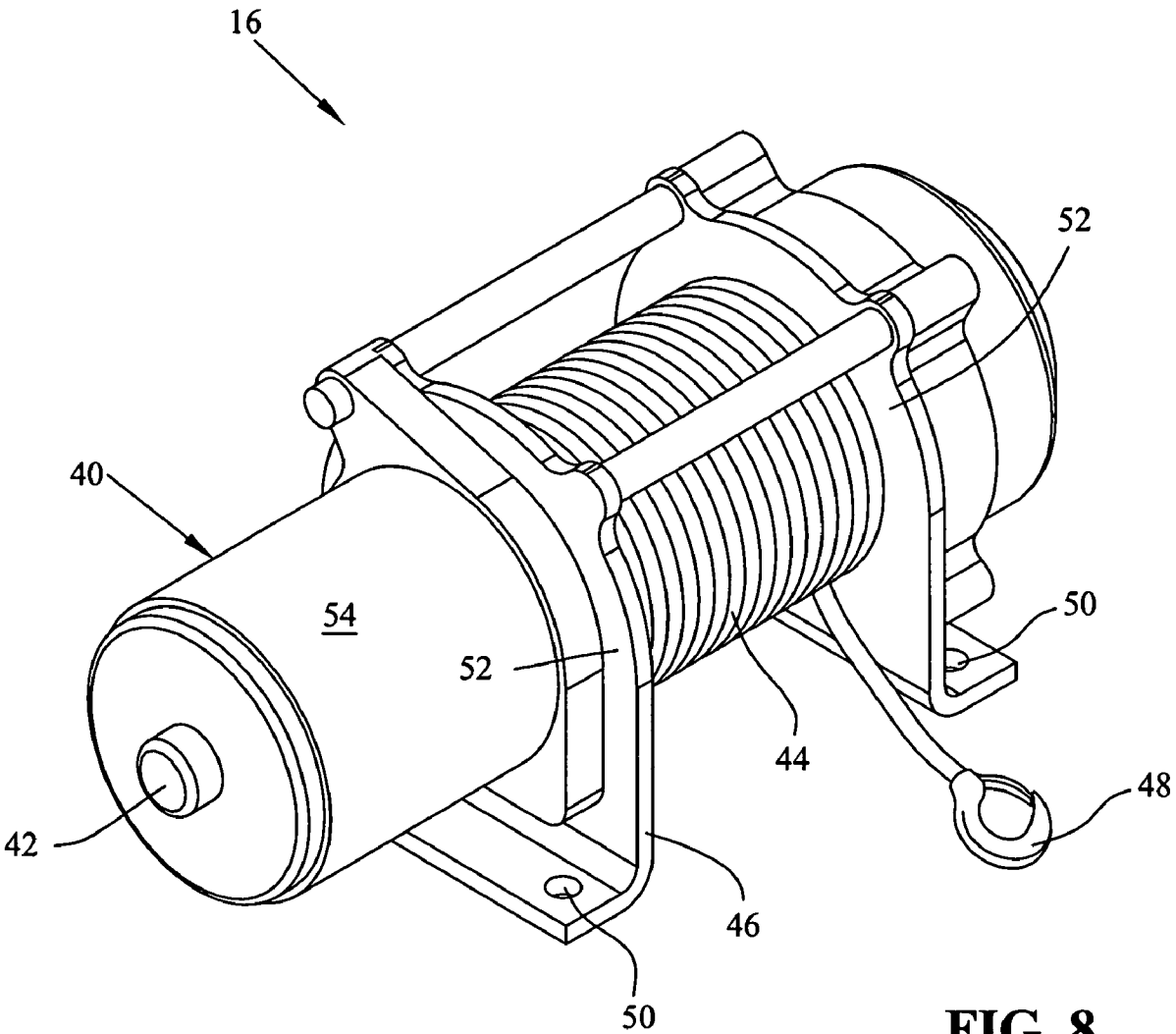
FIG. 8 is a top perspective view of the winch shown in the assembled view of FIGS. 1-3.

With reference to FIG. 8, winch 16 includes a motor 40, a drum/axle 42 coupled to motor 40, winch cable 44, and frame attachment portions 46. Motor 40 is electrically coupled to the battery within battery booster pack 14 and is selectively operated by controls, as further described herein. Motor 40 is mechanically coupled to drum/axle 42 such that drum/axle 42 rotates at the direction of motor 40. Winch cable 44 is coupled to drum/axle 42 such that rotation of drum/axle 42 either retracts or extends winch cable 44 thereon depending on the direction of rotation urged by motor 40. A free end of winch cable 40 includes a hook 48 thereon for attaching to a stay or for attaching to winch cable 40 after being wrapped around a stay. Attachment portions 46 include apertures 50 for mounting to frame 12, as described herein. Additionally, attachment portions 46 include upper flanges 52 that abut a motor housing 54 and define therebetween, the area in which winch cable 44 collects on drum/axle 42.

Figure 9:
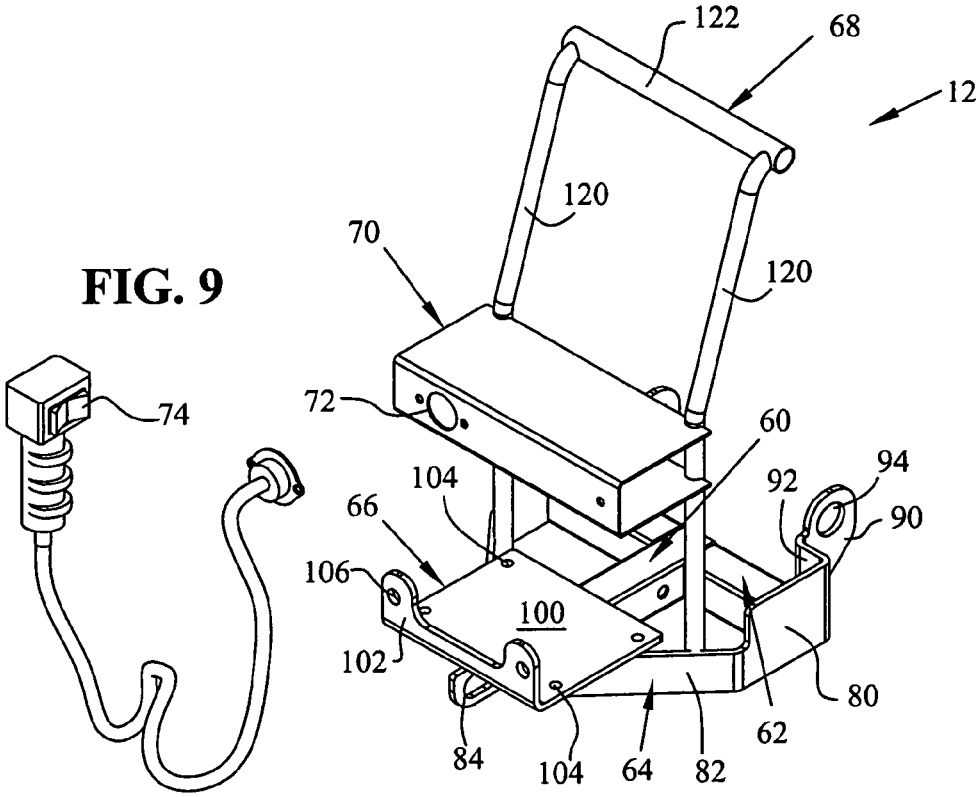
FIG. 9 is a top perspective view of a frame for supporting the powered winch.
Figure 10:
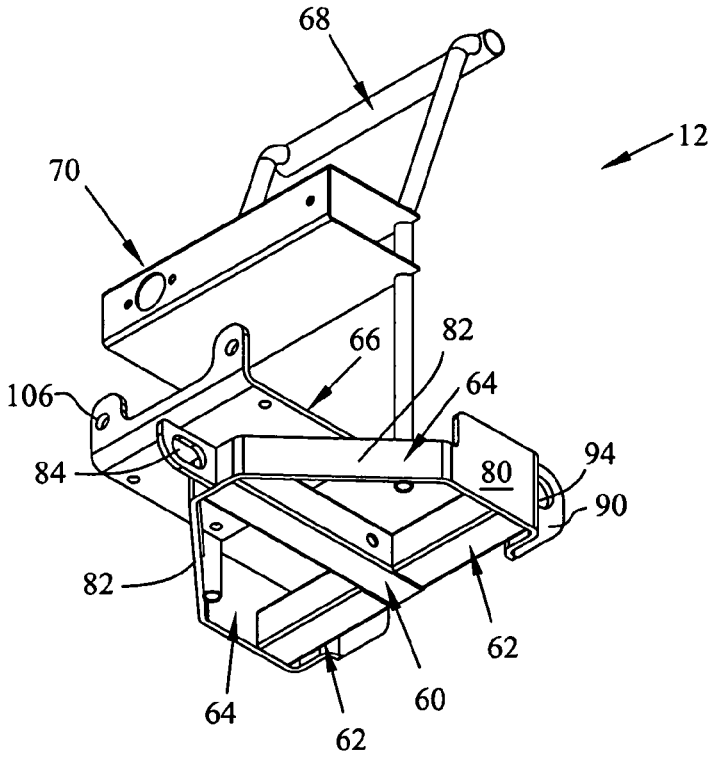
FIG. 10 is an underside perspective view of the frame of FIG. 9.

As shown in FIGS. 1-3, frame 12 provides a connection surface and support for battery booster pack 14, including the battery therein, and winch 16. With reference now to FIGS. 9 and 10, frame 12 includes a post tube 60, two offset tubes 62, and side frame portions 64. Frame 12 further comprises a winch plate 66, a handle portion 68, and a shroud 70 all welded together. Post tube 60 is of a substantially square cross section and sized to receive a mounting post (not shown) therein. The mounting post is of a size to be received in or be part of a hitch or mount on a vehicle such as an ATV. Post tube 60 may also include a key bore sized to receive a bolt or other fastener that can secure the mounting post within post tube 60.

Offset tubes 62 extend at right angles from opposing sides of post tube 60 to form a "T." Outer ends of offset tubes 62 couple to side frame portion 64. Side frame portions 64 include side plates 80, angled bracket portions 82, front eyelet 84, and rear mount ends 90, including rear plate 92. Brackets 82 narrow to support winch plate 66 thereon. Mount ends 90 include apertures 94 therein for use of the winch in the portable mode, as will described in greater detail herein.

Winch plate 66 includes a support 100 and a vertical guide mount 102. Support 100 includes apertures 104 which are spaced to cooperate with apertures 50 (FIG. 8) which in turn receive fasteners therein such as bolts to couple winch 16 to frame 12. Vertical guide mount 102 includes a pair of apertures 106 sized and located to align with similar apertures 108 in a winch cable guide 110 (FIG. 1). Cable guide 110 receives winch cable 44 through an opening 112 (FIGS. 1 and 2) to align winch cable 44 with a proper section of drum/axle 42, and to feed and retract the cable 44 within a defined lateral position, as will be described herein.

Handle portion 68 includes two vertical extensions 120 and a top bar 122 therebetween. Top bar 122 provides a grip surface suitable for carrying power winch 10 when not attached to a vehicle. Shroud 70 is coupled to vertical extensions 120, and extends horizontally therefrom. Shroud 70 provides space for wiring and connections to an external power supply to charge the battery. A relay (not shown) is positioned in aperture 72 (FIG. 9) and is interconnected between the battery and motor to control the winch as is known in the art. A tethered control 74 (FIG. 9) is electrically connected to the relay, to remotely control the operation of the winch in order that an operator may locate himself remotely from winch 16, out of the path of working objects. An electrical connector (not shown) can be used to interconnect the battery 14 to the relay, so as to be easily disconnected, if the battery pack 14 needs to be removed from the frame 12.

Figure 11:
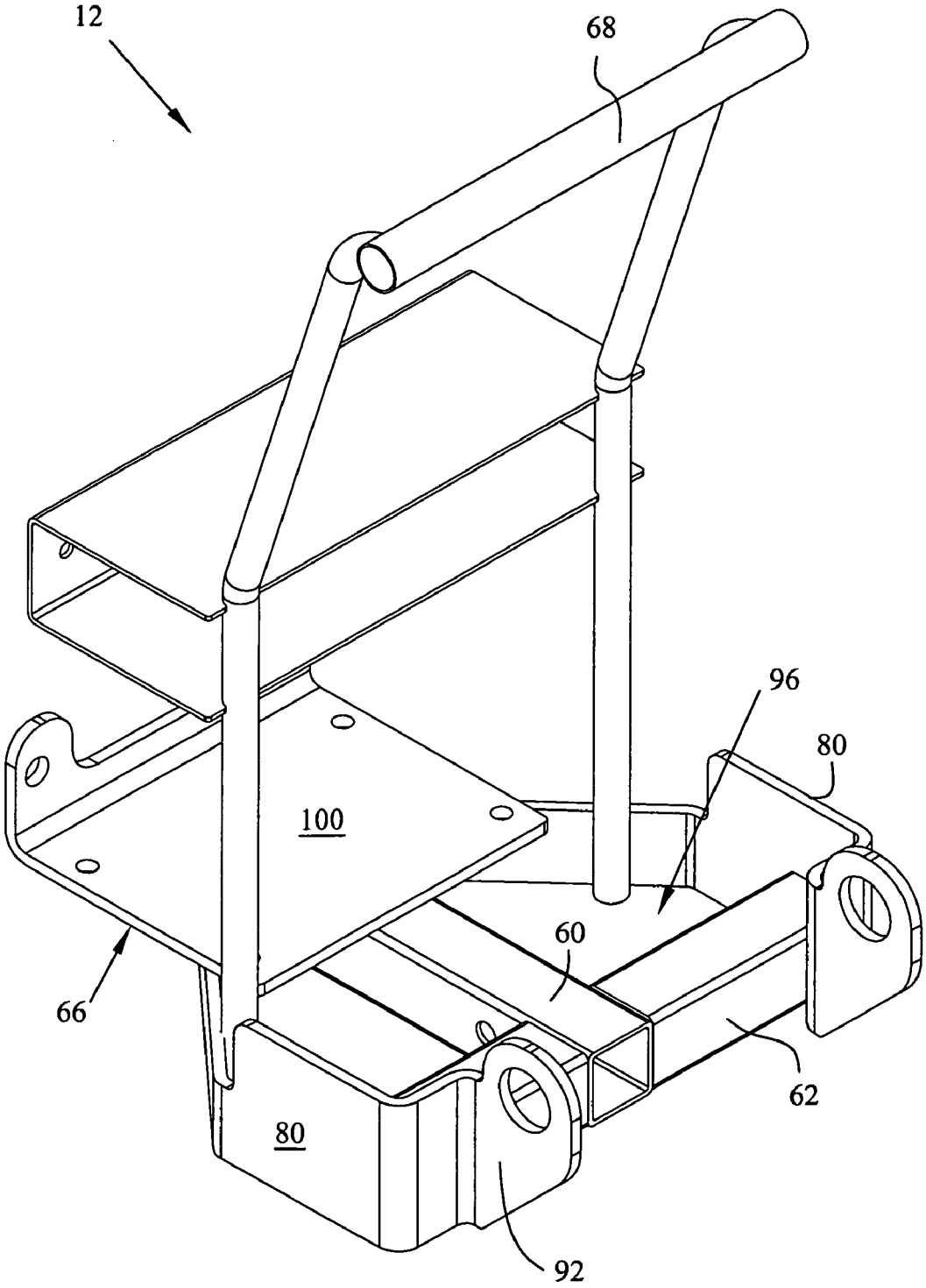
FIG. 11 shows a rear perspective of the frame of FIG. 9.

The frame 12 provides an ergonomic carrying device for the battery booster pack 14. Offset tubes 62, post tube 60, and frame 12 generally, combine to provide a support surface for battery booster pack 14. More particularly, the combination of tubes 60, 62, side plates 80, and rear plates 92 form a nest 96 (FIG. 11) for receipt of the reduced cross section portion 39 (FIG. 5) of battery power pack 14. The manner in which the reduced cross section portion 39 nests, is best depicted in FIGS. 1-3. Moreover, the vertical extension portions 120 are profiled to angle with the contour of the battery pack 14, with the top bar 120 being positioned proximate to the handle portion 21 of the battery booster pack 14, as also best shown in FIGS. 1 and 3. Thus the entire device may be picked up with one hand by grasping the top bar 120 and handle 21 together. Additionally, VELCO® straps (not shown) can be wrapped around the top bar 120 and handle 21 to temporarily hold the two together.

Powered winch 10 combines the attributes of a high power battery booster pack and a traditional ATV winch. The battery may be recharged by coupling to a vehicle's charging system through a 12V cord such as a cigarette lighter outlet or by 120V transformed current off the vehicle. Jumper cables 32 and jumper clamps 34 allow the portable battery to provide a jump starting power source or a portable 12V and 120V power if used in conjunction with a DC/AC adapter.

Alternatively, winch 16 and the battery power source may be provided as separate components such that winch 16 may be attached to the portable battery or to the vehicle via quick disconnect terminals, to receive power therefrom. In such a configuration, the battery may be removed from frame 12 and taken remotely from frame 12.

Thus the winch assembly may be used in at least two alternative ways. That is, the frame can be attached to the front or the back of the vehicle or may perform non-vehicle related winching/lifting tasks.

First, the frame 12 provides for portable winch to be attachable to a vehicle to provide a solid stay. The tube 60 is profiled for mounting to a square tube type trailer hitch for mounting the assembly 10 to either the front or rear of an ATV, or other vehicle.

Alternatively, the assembly may be removed and used remotely. In this manner, the winch may be tied off by way of the apertures 94 (FIGS. 9 & 10). For example, a clevis (not shown) can be attached to each of the apertures 94, which in turn can be attached to a chain, nylon strap or the like to connect to a stay.

Also as shown best in FIG. 9, the frame is designed in an ergonomic manner for carrying the assembly, when the unit is used alone. More particularly, handle portion 122 is centrally located relative to the assembly, and acts as a fulcrum for the assembly. The battery booster pack 14 is mounted on one side of the fulcrum, while the winch assembly is mounted on the opposite side for balance and weight distribution. In addition, if the user needs to carry the unit to a distant location, the battery pack 14 may be disconnected and removed from the frame and carried separately, one in each hand.

It should also be appreciated that the geometry of the device has been designed to provide little to no torque on the winch itself. More particularly, the winch has been designed to offset the pulling forces seen by the winch to provide little torque on the unit, providing a stable system. First, and with reference to FIG. 2, the opening 112 is laterally aligned between the two apertures 94, such that little to no torque is applied to the winch in the vertical axis. Also, the opening 112 and the apertures 94 are vertically equidistant from a common reference point, for example, from the bottom edge of frame 12. This prevents a torque on the winch in an axis parallel to the axis going through the apertures 94.

Figure 12:
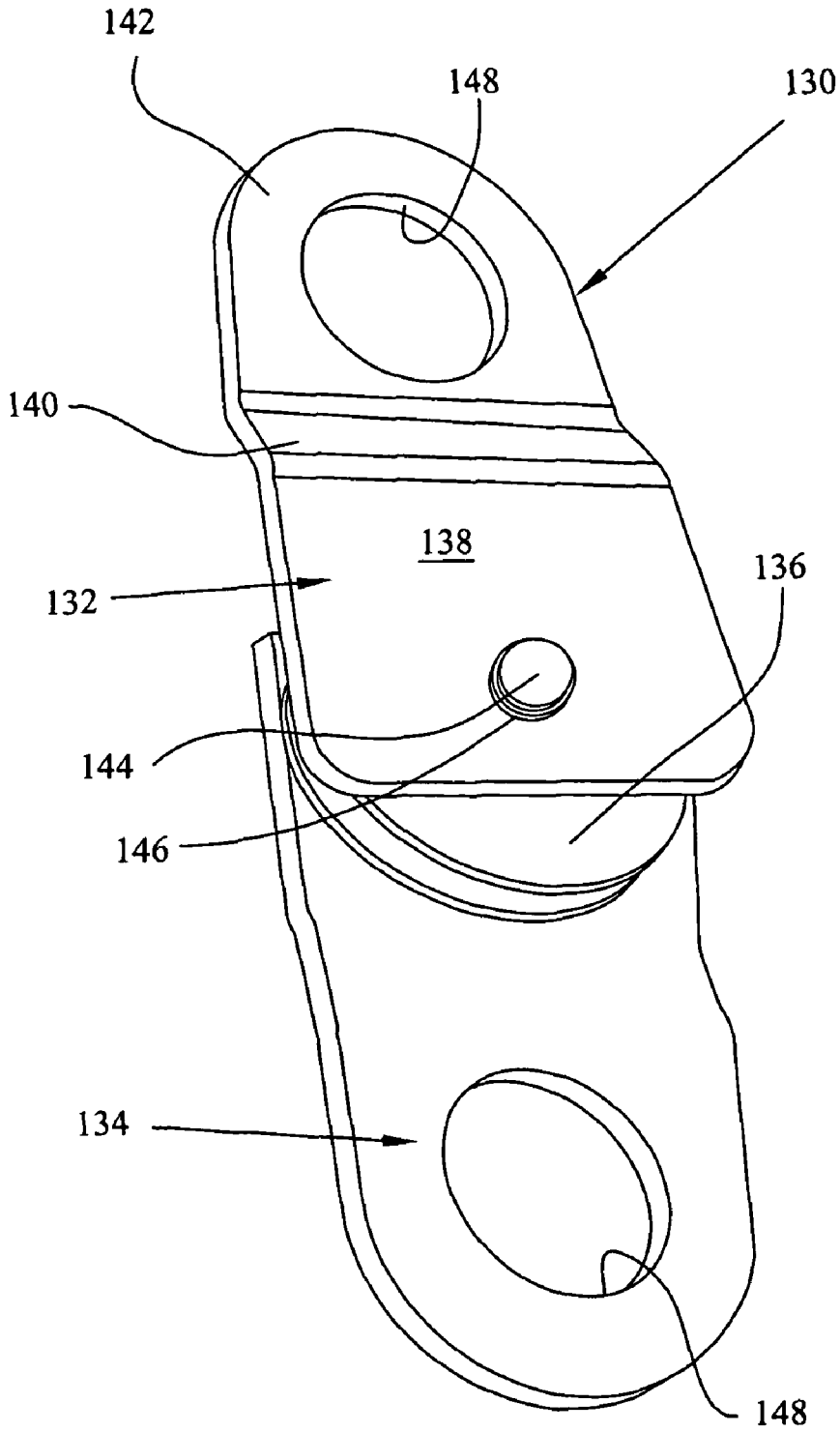
FIG. 12 shows a perspective view of a pulley assembly for use with the winch.
Figure 13:
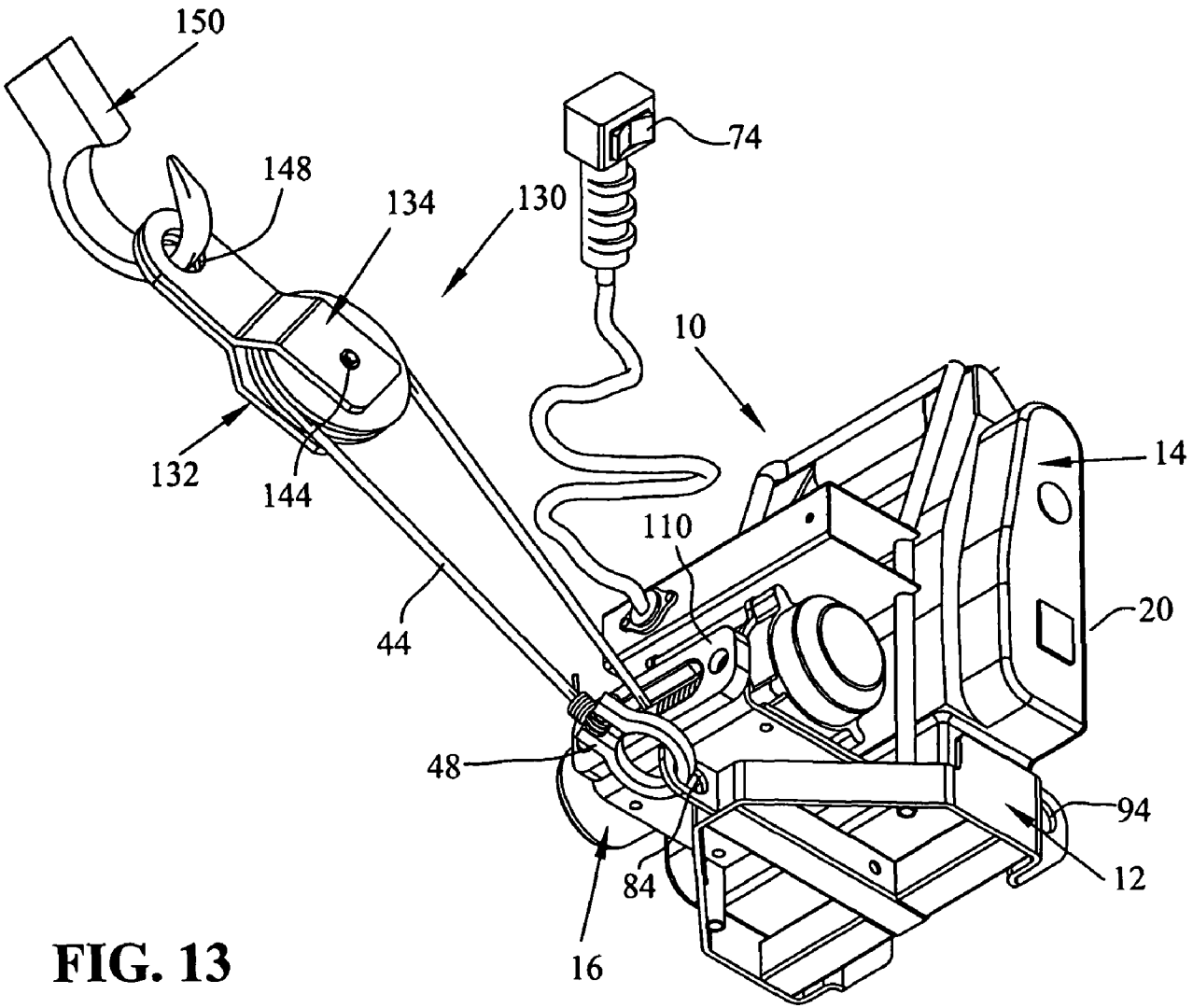
FIG. 13 shows the pulley assembly of FIG. 12 in position for use with the winch.
Figure 14:
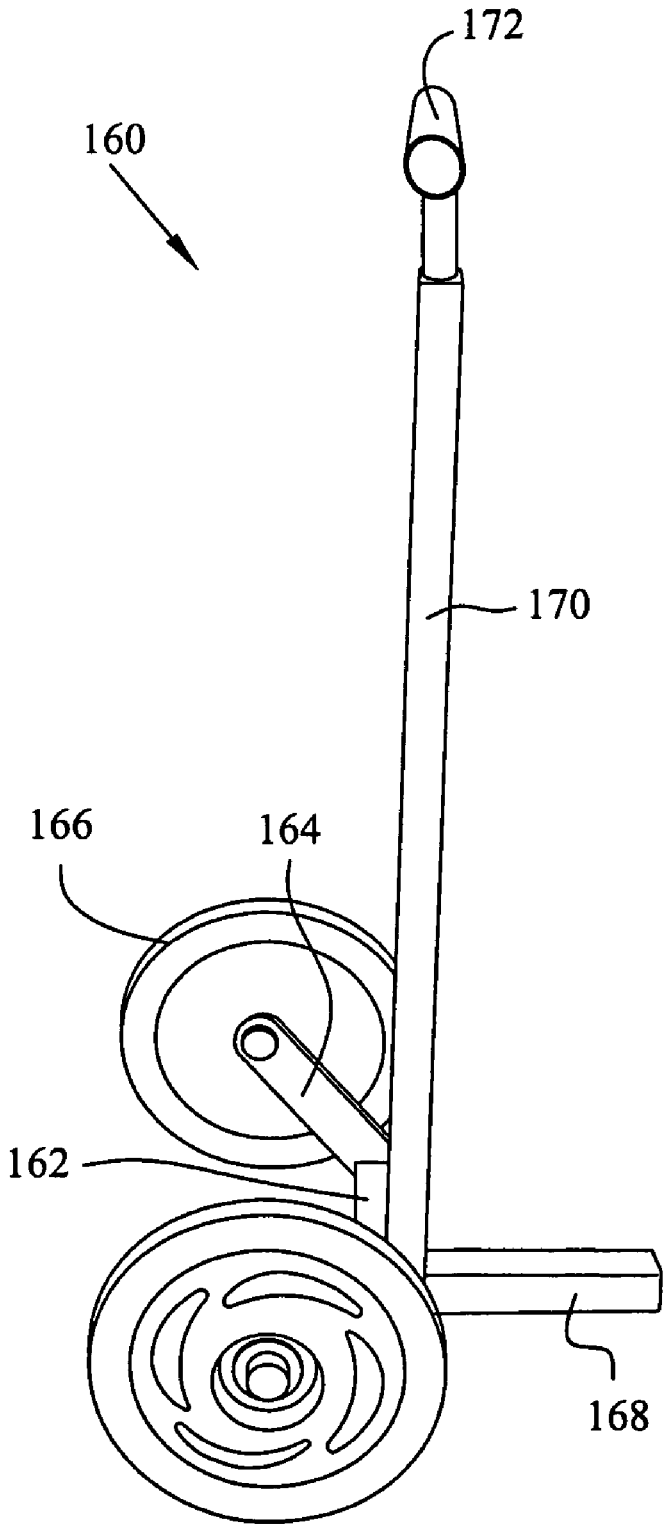
FIG. 14 shows a dolly for use with the winch of the above mentioned Figures.

With reference now to FIGS. 12 through 14, other accessories usable with the winch assembly described above will be explained. With reference first to FIG. 12, a pulley assembly 130 is shown comprised of plate members 132, 134, and pulley 136. Each of the plate members 132, 134 is comprised of a flat plate portion 138 and angled portion 140 which transitions the plate end 142 towards the center line of pulley 136. Each of the plates 132, 134 and pulley 136 are commonly attached by way of a pin 144 which may be attached in multiple ways although a snap ring 146 is shown in FIG. 12. Each of the plate portions 142 includes an aperture 148.

With respect to FIG. 13, the pulley assembly 130 can be used in combination with winch 10 to increase the pulling capacity of the winch. When the pulley is in the configuration of FIG. 12, the pulley is accessible, and cable 14 may be wrapped there around. The pulley 136 is easily accessible as plates 132 and 134 independently rotate relative to each other, and can be further rotated to the position of FIG. 13 where apertures 148 are aligned. A further hook or other mechanism may be attached through apertures 148 and attached to the item to be pulled by winch 10, as shown in FIG. 13. Thus the pulley assembly 130 acts a block and tackle type assembly increasing the pulling capacity of cable 44.

With reference now to FIG. 14, a dolly 160 for use with the winch 10 is shown. Dolly 160 is generally comprised of an axle 162, to which are attached brackets 164 carrying wheels 166. On the opposite side of axle 162 is provided a mounting peg 168, which as should be appreciated is profiled as a square configuration which is receivable in post 60 (FIG. 11) of frame 12. A vertically upright handle 170 is attached to axle 162 which is telescopic and includes handlebar 172. Thus in operation, if the portable winch is to be used and moved distant from its location, peg 168 can be inserted into post 60 of frame 12 and the user can simply grasp handlebar 172 and rotate handle 170 rearwardly (counter clockwise as viewed in FIG. 14) to lift the winch assembly.

While certain embodiments of the present invention have been described in detail, those familiar with the art to which this invention relates will recognize various alternative designs and embodiments for practicing the invention as defined by the following claims.

What is claimed is:

1. A portable winch, comprising;

a frame;

a power source selectively mounted on the frame;

an electric winch mounted to the frame, the electric winch comprising an electric motor coupled to the power source; and a jumper having a first end connected to the power source and a second end having a connection device for electrically coupling the power source to a power-consuming device not associated with the electric winch to provide power thereto.

2. The portable winch of claim 1, wherein the jumper connection device is profiled as battery jumper cables having battery clamps.

3. The portable winch of claim 1, wherein the power source provides power to the power-consuming device regardless of whether the power source is mounted on the frame.

4. The portable winch of claim 1, wherein the frame provides a carrying handle.

5. The portable winch of claim 1, wherein the frame comprises a mounting mechanism for mounting the frame to a vehicle.

6. The portable winch of claim 1, wherein the frame comprises a mounting mechanism for mounting the frame to a stay.

7. The portable winch of claim 1, wherein the frame comprises a first mounting mechanism for mounting the frame to a vehicle, and a second mounting mechanism for mounting the frame to a stay.

8. The portable winch of claim 1, further comprising a remote control to operate the device.

9. The portable winch of claim 8, wherein the remote control is a tethered remote control.

10. The portable winch of claim 8, wherein said remote control is comprised of a wireless control switch.

11. A portable winch apparatus, comprising:

a frame;

a mount coupled to the frame having a first mounting portion for mounting the frame to a vehicle and a second mounting portion for mounting the frame to a stay;

an electric winch mounted to the frame; and a power source removably mounted on the frame and electrically connected to the winch, the power source having at least one connection device for providing power to a power consuming device other than the winch, and wherein the power source is profiled to be electrically coupled to a power source of the vehicle.

12. The apparatus of claim 11, wherein the connection device comprises a jumper for electrically coupling the power source to the power-consuming device separate from the frame to provide power thereto.

13. The apparatus of claim 11, wherein the mount is sized and shaped to be mounted at a plurality of locations on a vehicle.

14. The apparatus of claim 11, wherein the power source is a battery.

15. The apparatus of claim 11, further comprising a housing substantially enclosing the power source.

16. The apparatus of claim 15, further comprising controls for directing the operation of the winch, the controls being located at an external position away from said housing.

17. The apparatus of claim 11, further comprising quick disconnect connections between the power source and the electric motor of the winch.

18. A portable winch, comprising:

a frame;

a mounting mechanism associated with the frame for mounting the frame to a stay;

an electric winch mounted to the frame, the winch having a cable feed opening;

the mounting mechanism and the feed opening being profiled to apply insubstantial torque to the frame when in operation, the mounting mechanism being comprised of two openings positioned at the opposite side of the frame as said cable feed opening, a mounting aperture adjacent to, and substantially laterally aligned with, said feed opening; and a pulley for placement around a cable of said winch, whereby a hook at a free end of said cable may be attached to the mounting aperture placing the combination of the winch and pulley in a block and tackle configuration.

19. The portable winch of claim 18, wherein said frame is profiled for alternatively mounting the frame to a vehicle or to a stay.

20. The portable winch of claim 18, wherein the vertical height of said cable feed opening, and said mounting mechanism is substantially equal.

21. The portable winch of claim 18, wherein the lateral position of said cable feed opening is substantially centered with the lateral position of said mount.

22. The portable winch of claim 18, wherein said pulley includes two plates with a pulley wheel rotatably attached therebetween, at least one of said walls being rotatable to access said pulley wheel.

* * * * *